United States Patent [19]

Bataille

[11] Patent Number: 4,884,349

[45] Date of Patent: Dec. 5, 1989

[54] HIGH BOOT WITH CABLES

[75] Inventor: Jean Bataille, Paris, France

[73] Assignee: Bataille Industrie, S.A., Vanves, France

[21] Appl. No.: 201,636

[22] Filed: Jun. 2, 1988

[30] Foreign Application Priority Data

Mar. 28, 1988 [FR] France ..... 88 04038

[51] Int. Cl.[4] ..... A43B 5/04

[52] U.S. Cl. ..... 36/119; 36/121

[58] Field of Search ..... 36/117–121

[56] References Cited

U.S. PATENT DOCUMENTS

| | | | |
|---|---|---|---|
| 3,718,995 | 3/1973 | Graup | 36/121 |
| 4,179,827 | 12/1979 | Vaccari | 36/119 |
| 4,534,122 | 8/1985 | MacPhail | 36/119 X |
| 4,570,364 | 2/1986 | Walkhoff | 36/121 |
| 4,583,306 | 4/1986 | Paris | 36/119 |
| 4,709,491 | 12/1987 | Morell et al. | 36/121 |
| 4,724,626 | 2/1988 | Baggio et al. | 36/119 |
| 4,811,503 | 3/1989 | Iwama | 36/119 |

FOREIGN PATENT DOCUMENTS

| | | | |
|---|---|---|---|
| 0146502 | 6/1985 | European Pat. Off. | 36/119 |
| 0258824 | 3/1988 | European Pat. Off. | 37/117 |
| 2708358 | 9/1977 | Fed. Rep. of Germany . | |
| 2350119 | 12/1977 | France . | |
| 2407681 | 6/1979 | France . | |
| 2292495 | 2/1982 | France . | |
| 2564711 | 11/1985 | France | 36/119 |
| WO87/05474 | 9/1987 | World Int. Prop. O. | 36/119 |

OTHER PUBLICATIONS

Ski Magazine, 1988–1989, p. 93.

*Primary Examiner*—James Kee Chi

*Attorney, Agent, or Firm*—Helfgott & Karas

[57] ABSTRACT

A high boot has a frame with cradles for supporting the leg and the instep, a rear support member connected to the frame and an operating lever pivoted relative to the frame. A cable is attached to the operating lever, which acts on the frame, upon pivoting the operating lever, so as to tighten the frame and the rear support member together or to release the frame and open the boot. A releasable stiffening device is interconnected between the front lower part of the boot and the rear support member to stiffen or release the boot.

10 Claims, 3 Drawing Sheets

HIGH BOOT WITH CABLES

BACKGROUND OF THE INVENTION

This invention concerns a high boot with laces.

Various methods are known for making high boots with hooked laces and levers for tightening onto the foot by means of boot straps and support plates; these boots are intended for widely different applications such as certain sports like skiing, mountain climbing, parachuting etc. (FR 75 35 488, DOS 27 08 358, FR 7 33 834, FR 76 13 689 and FR 77 33 834).

In every case the boots have to be fairly inflexible for use in the sport. On the other hand, when they are used in an intermediate stage, for example when walking to the start, it would be desirable for these boots to be as flexible as possible.

Now the present methods of making them do not permit such a combination of strength and flexibility.

According to the journal "Ski Magazine", page 93 (March 1988) there is known to be, in particular, a ski boot with a strap passing over the instep and bearing on the latter by means of a pressure spreading plate. The drawback of this boot is that its distribution of the stresses takes no account of the uneven anatomy of the foot, and is liable to injure the parts of the foot which go over the supporting area.

SUMMARY OF THE INVENTION

The object of this invention is to provide a boot, especially for sports use or more generally a technical boot which, to the liking of the wearer, can be fairly flexible to make normal walking easier and, in other respects, be capable of being stiffened to facilitate the practice of certain types of exercises or work, and which in addition can be easy for the wearer to put on.

The object of the present invention are attained by a high boot, characterised in that it consists of:

(A) a set of cables; and (B) a support and control component;

(C) a heel section;

(D) a releasable stiffening member;

the support and control component, combining with the cables to tighten them and fix the boot or loosen them and enable the boot to open to release the foot consists of:

- a frame positioned in front of the leg and provided with means of supporting the leg and the instep of the foot;
- a rear support member connected to the frame and receiving the calf of the leg;
- an operating lever mounted and pivoting on the frame, to which is attached a lace; the lever is able to assume, at the will of the skier, two stable positions, one for tightening the cables and the other for loosening them;

the releasable stiffening element is connected to the support and control device, at the front of the boot, via a fixing point for the rear support element;

- the flexible heel section connects the inside face of the boot at ankle level to the lower part of the frame, on both sides of the instep.

According to another embodiment, the means of supporting the leg and the instep consist of two flexible cradles connected in a movable manner to the frame in order to form a support coming up against the front part of the leg and the instep, without the leg and instep being able to come into contact with the frame.

According to another embodiment, the set of cables, on each side of the foot, consists of at least:

- a first cable connecting a fixed point at the top of the frame to the operating lever by passing through an aperture in the middle part of the frame and sliding in the rear support member;
- a second cable connecting a point on the boot at heel level to a fixed point of the frame at instep level;
- a third cable connecting a fixed point of the boot at sole level near the joint to a second fixed point of the lower part of the frame.

Introduction of the foot into the boot moves the frame by means of the heel section and tightens the second and third cables.

According to another embodiment, the second and third cables are crossed in the tightening position.

According to another embodiment, the frame consists of two parts connected by the pivot pin of the operating lever.

According to another embodiment, the operating lever passes through a metastable position.

According to another embodiment, the operating lever acts on the frame to move it into the open position and facilitate putting the boot on or taking it off.

According to another embodiment, each cradle consists of flexible cloth material attached to the frame in a pivoting manner at two connection points.

According to another embodiment, the rear support member consists of a part in the form of a shell surrounding the back and sides of the calf.

According to another embodiment, the releasable stiffening member consists of:

- two rigid side members connected to each other at the back of the boot by a hinged member;
- a device fixed to the front of the boot, forming a resilient stop against which the side members abut in the engaged position, this device being fitted with a retractable coupling;
- a guiding and linking device fixed to the side members and guided by the device forming the stop and working together with the coupling device either to be fixed to that device and abut the rigid side members against the device forming a stop or, after opening the coupling device, to release the side members and allow the boot to be opened.

According to another embodiment, the guiding and linking device is a Ω shaped spring, each end of which is fixed to a side member, and the device which forms the stop is fitted with lateral guides to receive the loop of the guiding part in the manner of a spring and allow it to pass over the coupling device and be fixed to it.

According to another embodiment, the releasable stiffening member consists of:

- two rigid side members connected to each other at the back of the boot by a hinged member;
- a device fixed to the front of the boot, forming a resilient stop against which the side members abut in the engaged position, this device being fitted with a retractable coupling;
- a connecting device is carried by the device forming the stop and consists of two arms latching flexibly into the respective notches at the front end of the side members, the release and engagement being effected by a thrust exerted on the connecting device.

The invention will be described in a more detailed manner by an example of the construction of the invention shown diagrammatically in the attached.

DETAILED DESCRIPTION OF THE PREFERRED EMBODIMENT

Figure 1:
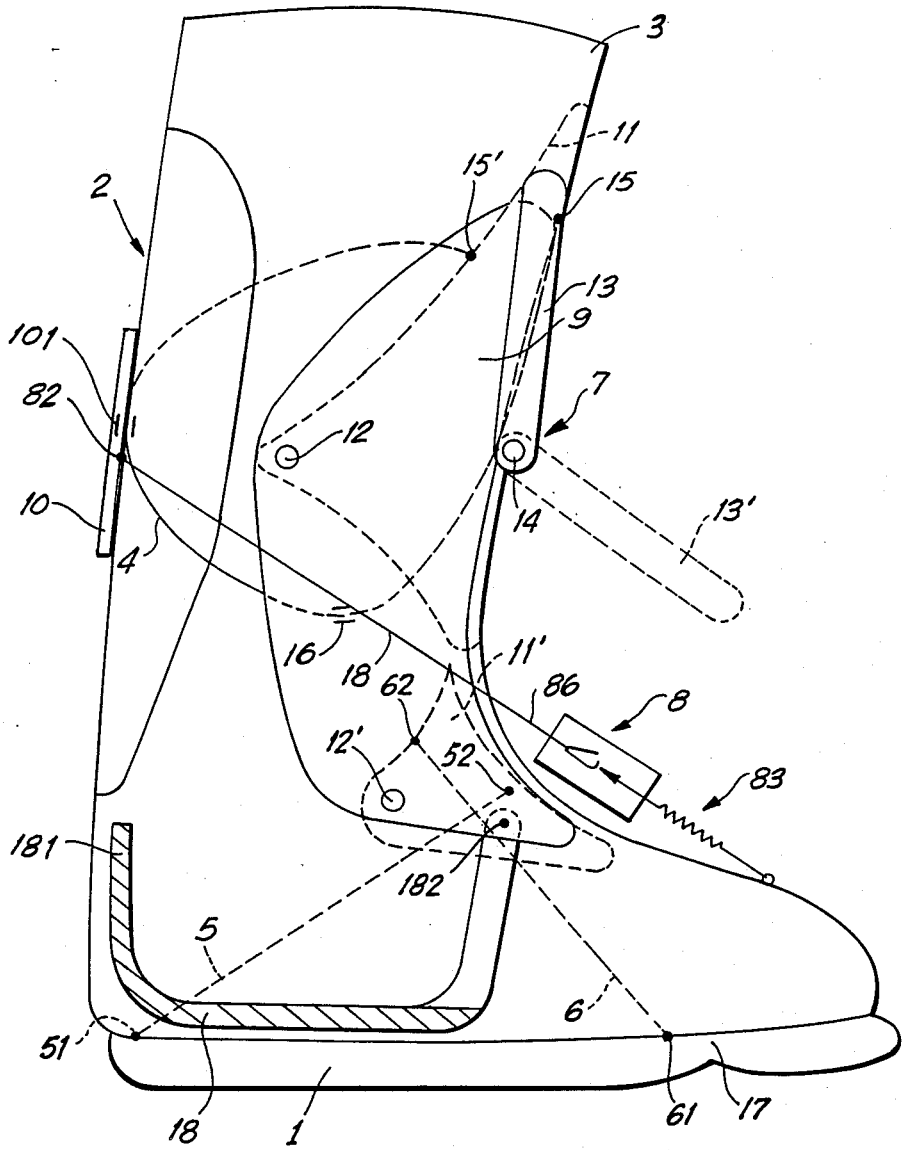
FIG. 1 is a side diagrammatic view of a high boot with cables.

According to FIG. 1, the boot consists of a sole 1 and an upper 2 and also a top part 3.

On each side of the boot, a set of cables 4, 5 and 6 connects different parts of the boot as will be explained below, to provide tightening or loosening of the boot.

The boot embodies a support and control unit 7, described below in detail, which serves to tighten and loosen the cables in order to lock the boot onto the foot or open it and enable the foot to be disengaged. A ski boot is usually formed in a simplified manner of an upper and a front and back part which can move in relation to each other to permit taking the boot on and off. This boot has that type of structure. The boot also has a releasable stiffening member 8.

In more detail, the support and control device 7 consists of a frame 9 located in front of the leg and working together with a rear support member 10 receiving the calf. This member 10 is linked to the frame by means of the cable 4.

A flexible cradle 11 is connected in a movable manner to the frame 9. This flexible cradle 11 is made from a supple cloth material which for preference is not stretchable or is difficult to stretch, and which forms a support bearing against the front part of the leg. The cradle 11 prevents the front part of the leg from coming into contact with the frame 9. The flexible cradle 11 is connected to the frame 9 by means of two fixing points 12, one of which is shown, on one side of the boot, the other being on the other side. The frame 9 also carries a cradle 11' which caps the instep. The cradle 11' is connected to the frame 9 by the fixing points 12'.

The frame 9 also carries an operating lever 13 shown by an unbroken line in the raised position and a broken line 13' in the lowered position. This operating lever is mounted to pivot on the pin 14 on the frame 9.

The frame 9 can, for example be in one piece in the form of a shell surrounding the front of the foot or again in two parts connected by the pin 14 of the operating lever 13.

The first cable 4 connects a fixed point 15' at the top part of the frame 9 to a fixed point 15 of the lever 13. This cable 4 goes through the frame 9 by an aperture situated approximately in its middle part 16 and the rear support 10 by a passage 101. The cable 4 can slide in the passages 16 and 101 during the tightening and loosening movements of the boot.

The second cable 5 connects a point 51 situated at the back of the boot at heel level to a fixed point 52 of the frame 9, at the level of the instep.

The third cable 6 connects a fixed point 61 of the boot at sole level close to the bending part 17 of the foot to a second fixed point 62 of the frame 9 likewise at instep level. According to a construction, the second and third cables 5 and 6 are crossed in the tightening position, which makes it easier to tension the cables.

It must be noted that the term cable or wire which is utilized is likely to stretch very little under its conditions of use. This cable can be fairly stiff.

The words "fixed point" are used to indicate the attachment of the ends of the cables as opposed to the apertures allowing them to slide.

Finally as already indicated, the set of cables consists of laces provided for both sides of the boot; only the cables which appear on one side are shown and described.

To facilitate movements and improve the holding power, it is an advantage for cable 4 to pass round the back of the boot, going from the outer side of the boot towards the inner side. In these conditions, the other first cable will trace a symmetrical path and the first pair of cables will cross at the back of the boot. This arrangement also helps the lacing effect.

As pointed out above, cable 4 is attached to the lever 13; when this lever is in the position shown by the solid line, the cable is tightened; if it is in the lowered position 13' the cable is slackened. In the first position, the boot is tightened onto the foot; in the other it is loosened and can be opened to allow withdrawal of the foot.

In the manner of construction described above, the lever 13 passes through a metastable position when it is forced from the closed position to the opening position or vice versa. This metastable position, which results simply from the exertion of tension on the cables, ensures stability of the operating lever by preventing its inadvertent opening except in rare circumstances.

It is also an advantage for the pivot pin 14 (or the two pivot pins for hinging the lever 13 to the frame 9, especially if this frame is in two parts) to be directed in such a way that when the lever 13 is in position 13', the two parts of the frame 9 separate to facilitate putting on or taking off the boot.

In its lower part, the boot has a flexible heel section 18, connecting the rear face of the boot at level 181 of the ankle to the top of the frame 9, on both sides of the instep at fixed point 182.

During its insertion into the boot, the foot presses on this heel section 18 and pulls on the frame 9, causing closure of the boot upper. As shown, the heel section consists of a rear part continuing by a base which is itself connected at the points 182 by two branches.

The releasable stiffening member 8 is designed to ensure the strength of the boot at the level of its articulation point 17 and especially of the malleolar (ankle joint) articulation which is not shown.

Figure 2:
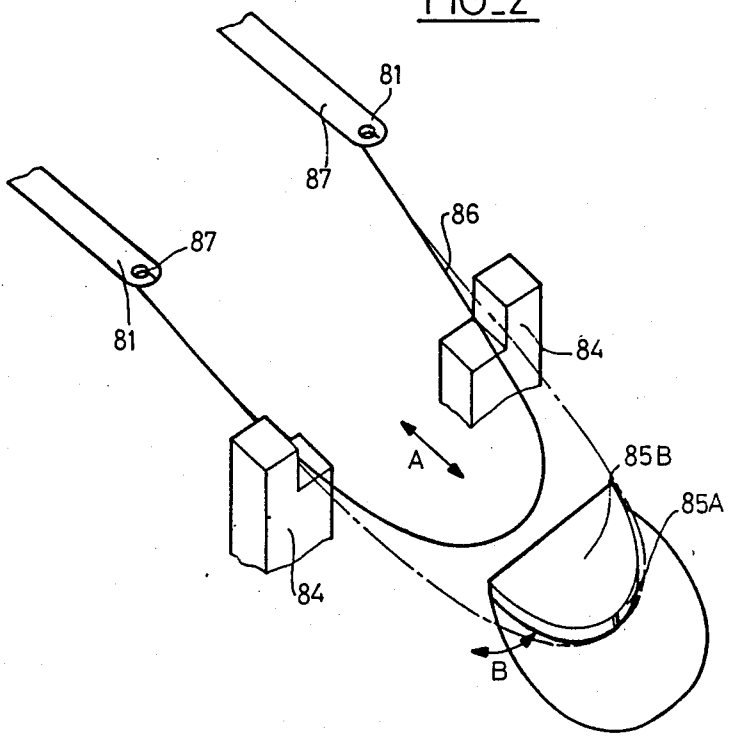
FIG. 2 is a perspective view of a stiffening device according to a first embodiment.

According to one manner of construction shown (FIGS. 1 and 2), this releasable stiffening member 8 consists of two rigid lateral members 81 positioned on each side of the boot and joined together at the rear of the boot by a hinged member 82. This hinged member 82 can be either a simple hinge carried by the rear part of the boot upper part, or a piece fitted with a hinge for each side member 81. In this latter case, the hinges can be extended sideways. A device forming a stop 83 is fixed to the front of the boot to operate together with each of the side members. This device 83 which forms a resilient stop against which the members 81 abut when the user makes a forward flexing movement, embodies guide pieces 84 and a retractable coupling device 85.

According to a not shown embodiment, the guide members 84 against which the rigid devices 81 abut when in the engaged position, are mounted to slide against the action of a return spring. This spring can also retract the coupling device.

According to a variant of the construction described above, guiding is effected on two rods fixed at the front of the boot and directed towards the back, in a sloping manner so as to be approximately within the extension of the rigid members put in the engaged position. In this case, the guide devices 84 are carried by a member sliding on the two rods, each having at least one spring of adjustable hardness. It is also possible to provide for a spring on each side of the sliding member.

The stiffening member 8 is completed by a connecting and guiding device 86 in the form, for example, of a loop of flexible cable. The two ends 87 of the loop are connected to the ends of the side members 81, and the body of the loop 86 is guided in its reciprocating movement (arrow A) by the guide devices 84.

The retractable anchoring device 85 is pivoted flexibly in the direction of the arrow B. This device 85 has a hooking-on rim 85A round which the loop of device 86 is placed to attach it amply there; the device 85 is raised.

To release the loop, it is sufficient to lower the member 85 by pressing on the surface 85B.

Figure 3A:
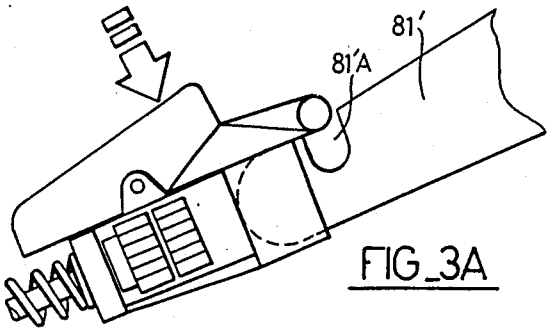
FIGS. 3A and 3B are top and side views of another embodiment of the stiffening device.
Figure 3B:
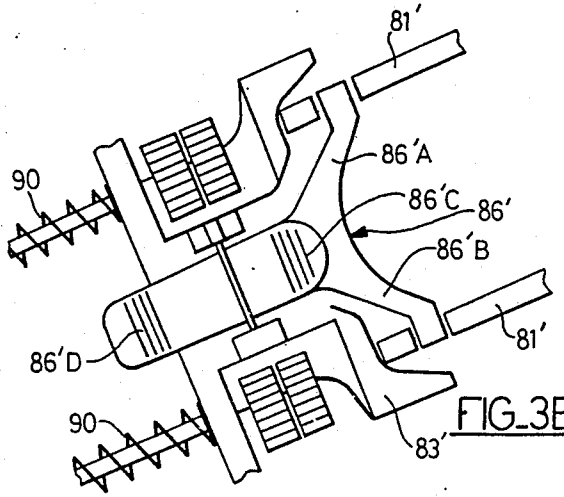
Figure 4:
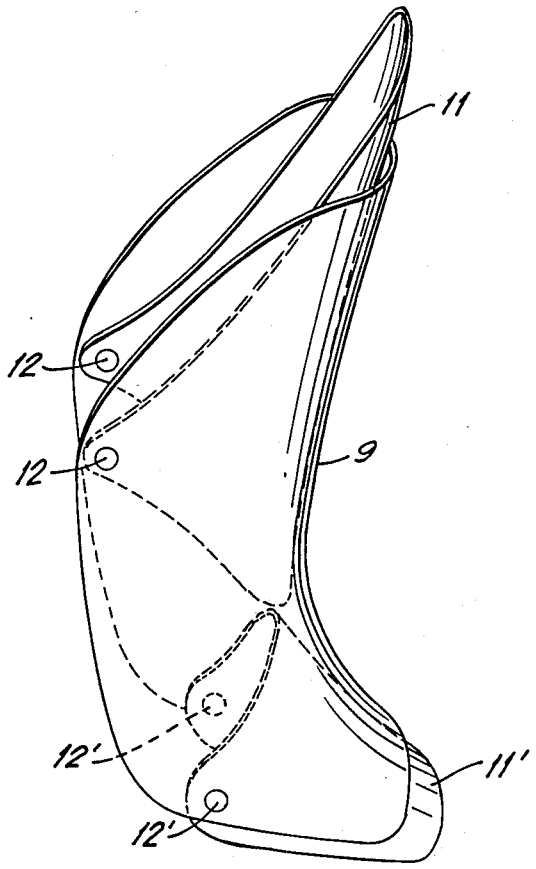
FIG. 4 is a perspective view of a frame and two cradles of the boot of FIG. 1.

FIGS. 3A and 3B show another embodiment for the releasable stiffening member 8. This Figure shows only a part of this member, i.e. the side member 81' ending in a notch 81'A and the unit forming the stop 83'. The connecting device 86' carried by member 83' consists of two arms 86'A and 86'B terminating in hooks designed to hook themselves into the notches 81'A.

For locking or unlocking it is necessary to press on one or other of the members 86'C and 86'D to tilt device 86' in one direction or the other.

FIGS. 3A and 3B also show the springs giving resilience to the stop 83'.

Whatever the construction, the stiffening member can assume two states.

The boot described above works as follows, firstly when being put on and then when being taken off.

In one of the states, the boot is stiffened, in the other it is flexible and the hinge at 17 can operate fully.

This stiffening member 8, and especially the front part 83 together form a flexible device allowing a certain elasticity on compression for flexing movements of the boot, while retaining the inflexibility of the sole.

Putting on the boot

The boot is open: the user slips his foot into it and by this movement depresses the heel section 18 which tilts the frame 9 under the effect also of foot pressure against the cradle 11'. The cables 5 and 6 are then tightened and the foot is held even more since movement of the frame 9 has also activated the closing of the top part of the upper.

To complete the closure, it is sufficient to raise the lever 13 by moving it beyond its metastable position whereby lever 13 acts on cable 4 to tighten frame 9 and support member 10 together.

The user can now completely lock the boot and turn it into a ski boot by making a bending movement of the leg. The connecting member 86 moves forward and latches onto the coupling device 85 so that the stiffening member 8 is then locked. There only remains the elasticity of the stiffening element.

To unlock the boot, it is sufficient to retract the coupling device 85 to free the linking device 86 and disengage the stiffening member 8. The boot than has a certain flexibility.

It is possible to obtain still more flexibility by lowering the lever 13 and thus slacken cable 14.

Taking off the boot

The device 8 being disengaged and the lever 13 lowered, the lace 4 is slackened. The foot can then be withdrawn from the boot, release of the heel section 18 making complete opening of the boot easy.

I claim:

1. A high boot, for skiing or the like, comprising at least one set of cables;

support and control means connected to at least one of said cables;

a heel section;

a releasable stiffening member, the releasable stiffening member and the support and control means being operative to tighten the boot or to permit opening of the boot and withdrawal of the foot from the boot, said support and control means including a frame situated in front of the leg and provided with cradle means of support for the leg and the instep of the foot, a rear support member receiving the calf and connected to the frame, and an operating lever pivotally mounted on the frame to which said at least one of said cables is attached, said at least one of said cables extending through said frame and said rear support member, and other of said cables being interconnected between said frame and the boot, said lever being pivotable, at the will of the skier, between two stable positions, of which one position is taken to tension said cables and thereby to tighten said frame and said rear support member together, and another position is taken to slacken said cables to thereby release the boot, said releasable stiffening member being interconnected between a front of the boot and a rear of the boot, and being operated to stiffen or release the boot, said flexible heel section linking an inner face of the boot at an ankle level with a lower part of the frame on both sides of the instep.

2. A boot according to claim 1, wherein the cradle means of support for the leg and instep includes two flexible cradles connected to the frame to form a support against the front part of the leg without allowing the leg and instep to come into contact with the frame.

3. A boot according to claim 1, wherein the set of cables is provided on each side of the foot, each set including a first connecting a fixed point at the top part of the frame to the operating lever and passing through a passage formed in a middle part of the frame and sliding in the rear support member, a second cable connecting a point of the boot at the heel level to a fixed point of the frame at the instep level, and a third cable connecting a fixed point of the boot at the sole level close to a bending point to a second fixed point of the lower part of the frame, said frame being moved by means of the heel section and causing tensioning of the second and third cables upon insertion of the foot into the boot.

4. A boot according to claim 3, wherein the second (5) and third (6) laces are crossed in a tightening position.

5. A boot according to claim 1, wherein the frame is formed of two parts connected by a pin of the operating lever.

6. A boot according to claim 2, wherein each cradle consists of a resilient cloth material pivotally connected to the frame by two coupling points.

7. A boot according to claim 1, wherein the rear support member consists of a shell surrounding the rear and sides of the calf.

8. A boot according to claim 1, wherein the releasable stiffening member includes two rigid side members linked together at the back of the boot by a hinged member, a stop device fixed at the front of the boot and forming a resilient stop against which abut the side members in an engaged position, said stop device being provided with a retractable coupling device, and a guiding and linking device fixed to the side members and guided by the stop device and cooperating with the coupling device intended either to be fixed to the coupling device and to cause the rigid side members to abut on the stop device or, after opening up the coupling device, to release the side members and permit the opening of the boot.

9. A boot according to claim 8, wherein the guiding and linking device is a Ω shaped spring, each end of which is fixed to the side member and the stop device is provided with lateral guides to receive a loop of the guiding and linking device flexibly and allow it to pass over a top of the coupling device and be fixed thereto.

10. A boot according to claim 1, wherein the releasable stiffening member includes two rigid side members connected to each other and the rear of the boot by a hinged member, a stop device fixed at the front of the boot and forming a resilient stop against which the side members abut in an engaged position, said stop device being fitted with a retractable coupling device, and a linking device supported by the stop device and formed of two arms which can engage flexibly into respective notches at front ends of the side members whereby engaging and disengaging is effected by pressing on the linking device.

* * * * *